US005568999A

United States Patent [19]

Egan et al.

[11] Patent Number: 5,568,999

[45] Date of Patent: Oct. 29, 1996

[54] RETAINING WALL BLOCK SYSTEM

[75] Inventors: Philip D. Egan, Atlanta, Ga.; Paul Specht, Wilmette, Ill.

[73] Assignee: The Tensar Corporation, Atlanta, Ga.

[21] Appl. No.: 416,074

[22] Filed: Apr. 3, 1995

[51] Int. Cl.[6] ..... E02D 5/00

[52] U.S. Cl. ..... 405/262; 405/284

[58] Field of Search ..... 405/258, 262, 405/285, 284, 286, 273

[56] References Cited

U.S. PATENT DOCUMENTS

| | | | |
|---|---|---|---|
| 770,844 | 9/1904 | Church . | |
| 1,349,166 | 8/1920 | Paff . | |
| 1,663,453 | 3/1928 | Coke-Hill . | |
| 3,421,326 | 3/1964 | Vidal . | |
| 4,374,798 | 2/1983 | Mercer . | |
| 4,379,659 | 4/1983 | Steiner . | |
| 4,470,728 | 9/1984 | Broadbent . | |
| 4,521,138 | 6/1985 | Steiner . | |
| 4,530,622 | 7/1985 | Mercer . | |
| 4,661,023 | 4/1987 | Hilfiker . | |
| 4,668,129 | 5/1987 | Babcock et al. . | |
| 4,671,706 | 6/1987 | Giardini . | |
| 4,684,294 | 8/1987 | O'Neill . | |
| 4,728,227 | 3/1988 | Wilson et al. . | |
| 4,804,299 | 2/1989 | Forte et al. . | |
| 4,884,921 | 12/1989 | Smith . | |
| 4,920,712 | 5/1990 | Dean, Jr. . | |
| 5,044,834 | 9/1991 | Janopaul, Jr. . | |
| 5,066,169 | 11/1991 | Gavin et al. . | |
| 5,114,270 | 5/1992 | Riddle . | |
| 5,156,496 | 10/1992 | Vidal et al. | 405/284 X |
| 5,177,925 | 1/1993 | Winkler et al. . | |
| 5,214,898 | 6/1993 | Beretta . | |
| 5,224,801 | 7/1993 | Quaney . | |
| 5,282,700 | 2/1994 | Rodrique | 405/284 |
| 5,320,455 | 6/1994 | Mattox | 405/284 |
| 5,337,527 | 8/1994 | Wagenaar . | |
| 5,417,523 | 5/1995 | Scales . | |

FOREIGN PATENT DOCUMENTS

| | | |
|---|---|---|
| 0079880 | 5/1983 | European Pat. Off. . |
| 481435 | 9/1920 | France . |

OTHER PUBLICATIONS

General Electric, "The Handbook of Engineering Structural Foam", Jan. 1978, Cover, pp. 4–7, and Back Cover.

"Tensar® Concrete GeoWall Package" Brochure—1987.

*Primary Examiner*—William P. Neuder

*Attorney, Agent, or Firm*—Jacobson, Price, Holman & Stern, PLLC

[57] ABSTRACT

A retaining wall is formed by plastic wall blocks having fingers for extending through apertures in an end portion of a grid-like sheet of material. The remainder of the grid-like sheet of material extends rearwardly to reinforce the fill behind the retaining wall formed from a plurality of courses of the wall blocks. A curved lip at the edge of one side of each block engages a recess located on a juxtaposed side of an adjacent block. Hooks extending from a bottom member of each block engage a top member of a lower block in stacked courses of blocks. The blocks are made of a one-piece or two-piece construction. In the two piece construction, the front member is secured or securable to the remainder of the block to provide retaining walls of aesthetically different configurations.

57 Claims, 8 Drawing Sheets

RETAINING WALL BLOCK SYSTEM

FIELD OF THE INVENTION

This invention relates to a retaining wall block system, and more particularly, to a plastic retaining wall block system having means to mechanically secure extended lengths of grid-like sheets of material to selected courses of such wall blocks used to form a reinforced retaining wall or the like. Additionally, the wall blocks of this invention are designed for ease in positioning and locating individual blocks relative to each other during erection of end consumer or civil engineering constructions.

BACKGROUND OF THE INVENTION

Retaining walls are commonly used for architectural and site development applications. The wall facing must withstand very high pressures exerted by backfill soils. Reinforcement and stabilization of the soil backfill is commonly provided by grid-like sheet materials that are placed in layers in the soil fill behind the wall face to interlock with the wall fill soil and create a stable reinforced soil mass. Connection of the reinforcing material to the elements forming the wall holds the wall elements in place and resists soil backfill pressures.

A preferred form of grid-like tie-back sheet material used to reinforce the soil behind a retaining wall structure, known as an integral geogrid, is commercially available from The Tensar Corporation of Atlanta, Ga. ("Tensar") and is made by the process disclosed in U.S. Pat. No. 4,374,798 ("the '798 patent"), the subject matter of which is incorporated herein in its entirety by reference. However, other forms of grid-like tie-back sheet materials have also been used as reinforcing means in the construction of retaining walls, and the instant inventive concepts are equally applicable with the use of such materials.

In a brochure entitled "Concrete Geowall Package", published by Tensar in 1986, various retaining wall structures are shown using full height cast concrete panels. In one such retaining wall structure short strips, or tabs, of geogrid material, such as shown in the '798 patent, are embedded in the cast wall panels. On site, longer strips of geogrid are used to reinforce the wall fill, creating a stable soil mass. To connect the geogrid tabs to the reinforcing geogrid, the strands of one portion of geogrid are bent to form loops, the loops are inserted between the strands of the other portion of geogrid so that the loops project out of the second portion of geogrid, and a rod is passed through the loops on the opposite side of the second portion to prevent the loops being pulled back through, thereby forming a tight interconnection between the two portions of geogrid, sometimes referred to as a "Bodkin" joint.

Use of full height pre-cast concrete wall panels for wall-facing elements in a retaining wall requires, during construction, that the panels be placed using a crane because they are very large, perhaps 8 by 12 feet or even larger and, as a result, are quite heavy such that they cannot be readily manhandled. To avoid such problems in the use of pre-cast wall panels other types of retaining wall structures have been developed. For example, retaining walls have been formed from modular wall blocks which are typically relatively small as compared to cast wall panels. The assembly of such modular wall blocks usually does not require heavy equipment. Such modular wall blocks can be handled by a single person and are used to form retaining wall structures by arranging a plurality of blocks in courses superimposed on each other, much like laying of brick or the like. Each block includes a body with a front face which forms the exterior surface of the formed retaining wall.

Such modular wall blocks are usually formed of concrete, commonly mixed in a batching plant with only enough water to hydrate the cement and hold the unit together. Such blocks are commercially made by a high-speed process which provides a mold box having only sides, without a top or bottom, positioned on top of a steel pallet which contacts the mold box to create a temporary bottom plate. A concrete distributor box brings concrete from the batcher and places the concrete in the mold box and includes a blade which levels the concrete across the open top of the mold box. A stripper/compactor is lowered into the open, upper end of the box and contacts the concrete to imprint the block with a desired pattern and compresses the concrete under high pressure. The steel pallet located at the bottom of the mold box resists this pressure.

A vibrator then vibrates the mold box to aid in concrete consolidation. After approximately two to four seconds, the steel pallet is moved away from the bottom of the mold box which has been positioned above a conveyor belt. The stripper/compactor continues to push on the formed concrete to push the modular wall block out of the mold box onto the conveyor belt. This process takes about seven to nine seconds to manufacture a single wall block. The formed wall block is cured for approximately one day to produce the final product.

With this high-speed method of construction, it is not practical to embed short strips or tabs of grid-like material or the like in the blocks with portions extending therefrom in the manner of the pre-cast wall panels shown in the Tensar brochure, in order to enable interconnection with a grid-like reinforcing sheet material directly or by a Bodkin-type connection or the like. Therefore, other means for securing the reinforcing grid to selected concrete modular blocks used to construct a retaining wall have had to be devised. Most such techniques actually secure end portions of a sheet of reinforcing grid between layers of wall blocks, relying primarily on the weight of superimposed blocks to provide a frictional engagement of the reinforcing means between large surface areas of superimposed wall blocks to form a retaining wall. The nature of the large surface area of cementitous wall blocks having very rough surfaces contacting the reinforcing means tends to abrade, and thereby weaken, a polymeric sheet reinforcing material at the very point of interconnection with the retaining wall.

Additionally, although such cementitious wall blocks are individually lighter and easier to manufacture and use than full height, pre-cast concrete wall panels, they are still fairly expensive and relatively heavy, making them cumbersome and inconvenient for use in constructing relatively low retaining walls such as are commonly found in home landscaping. Additionally, the nature of the materials used in the production of such prior art modular wall blocks limits the versatility in design and aesthetic presentation in the finished product.

SUMMARY OF THE INVENTION

Therefore, it is a primary object of this invention to provide a simple and inexpensive wall block system usable by a consumer to easily erect a retaining wall wherein the wall blocks are formed of plastic or other comparable light-weight, easily molded materials.

Another object of this invention is the provision of such a wall block system wherein the individual wall blocks include means for securing extended lengths of grid-like sheet material, such as geogrid sheets, to reinforce the fill material supporting the retaining wall.

An important object of this invention is to provide a grid-to-block connection which does not rely in any significant way on the weight of superimposed courses of wall block or on a significant frictional engagement between the reinforcing grid material and the juxtaposed surfaces of the wall blocks.

Yet another object of this invention is the provision of a plastic wall block retaining wall system providing a grid-to-block engagement by virtue of a plurality of fingers projecting from each wall block.

Still yet another object of this invention is the provision of plastic wall blocks having integral positioning or locating means for laterally interconnecting adjacent blocks in each horizontal course and for vertically interconnecting juxtaposed wall blocks in each superimposed course, preferably engaging with their front faces vertically offset rearwardly.

A further object of this invention is the provisions of a wall block system for forming a retaining wall or the like incorporating a light-weight material for the blocks having a front face of an aesthetically appealing design.

Another important object of this invention is the provision of a plastic wall block comprising a basic block construction designed to receive a separate facing member enabling the consumer to customize the appearance of a retaining wall formed from such blocks.

According to a preferred embodiment of the instant inventive concepts, a plastic wall block may be structural foam molded as an integral product with a vertically extending front member, a generally horizontal bottom member extending rearwardly from the lowermost edge of the front member, and a top member extending rearwardly from the uppermost edge of the front member for a distance less than the bottom member. Reinforcing ribs may be readily provided where desirable or necessary.

The front surface of the front member may define the face of the retaining wall or a separate facing member may be selectively secured thereto according to a modified embodiment of this invention.

An arcuate lip may be provided on one side of each wall block adapted to interengage with a recess formed on the other side of an adjacent wall block to laterally connect adjacent wall blocks in each horizontally extending course of wall blocks. The arcuate lip is a vertically extending, outwardly projecting lip having a top edge and a bottom edge and defining a forwardly facing arcuate surface therebetween. The recess includes a top edge and a bottom edge connected by a vertically extending edge. The bottom edge of the lip rests on the bottom edge of the recess. The arcuate surface of the lip receives the vertical edge of the recess when adjacent wall blocks in a course of wall blocks are interengaged.

The top and bottom members converge inwardly and rearwardly from the side edges of the front face. The arcuate nature of the lip on the side of the wall block, in combination with the converging top and bottom members, facilitate the construction of a curved retaining wall from the blocks of the instant invention.

A plurality of upwardly and forwardly projecting fingers are provided on the rear of the bottom member of each block for connecting a rearwardly extending grid-like sheet of reinforcing material to the wall block. As indicated, a preferred grid-like sheet reinforcing material may be made according to the techniques disclosed in the above-identified '798 patent. Preferably, uniaxially-oriented geogrid materials as disclosed in the '798 patent are used, although biaxial geogrids or grid materials that have been made by different techniques such as woven, knitted or netted grid materials formed of various polymers including the polyolefins, polyamides, polyesters and the like or fiberglass, may be used. In fact, any grid-like sheet material, including steel (welded wire) grids, with interstitial spaces capable of being secured to selected plastic wall blocks in the manner disclosed herein are suitable. Such materials are referred to herein and in the appended claims as "grid-like sheets of material".

Utilizing the uniaxial techniques of the '798 patent, a multiplicity of molecularly-oriented elongated strands and transversely extending bars which are substantially unoriented or less-oriented than the strands are formed. The strands and bars together define a multiplicity of grid openings. With biaxial stretching, the bars are also formed into oriented strands. In either event, or when using other grid-like sheet of materials, the grid-connecting fingers are spaced apart equal to a spacing between strands of the grid-like sheet of material, but may also be spaced apart several times the spacing between strands such that most, but not every, grid opening receives a finger through it.

Spaced forwardly of the fingers and extending downwardly from the front of the bottom member of each wall block are at least two hooks adapted to engage the top of a block in a lower course of wall blocks. The hooks are preferably positioned to rearwardly shift superimposed blocks relatively to the course below thereby vertically offsetting the front faces of superimposed courses in the resultant retaining wall. Of course, these elements can be dimensioned and/or located to produce a retaining wall with the front faces of wall blocks vertically aligned, if desired.

At a construction site, a plurality of plastic wall blocks are laterally interengaged as described above to form a straight or curved course of blocks. The fingers are used to capture the end portions, and preferably a transverse bar, of elongated lengths of grid-like sheet of material, the remainder of which is stretched out and interlocked with the fill soil or aggregate. The sheets of grid-like material generally span a plurality of wall blocks in each course, at least in the production of a straight wall, and the grid-like material is embedded in earth which covers the fingers and fills the interior of the blocks to fix the first course of blocks in position. At the same time, the fill is reinforced by the grid-like material to create a stable mass behind the retaining wall. A further course of wall blocks are superimposed on the initial course, with the upper blocks laterally staggered with respect to the course below and interconnected by engagement of the hooks on the bottom of the upper blocks with the top wall of a pair of adjacent blocks below. Sheets of grid-like material are secured to the second course and covered with earth and further courses are added in the same manner until the desired wall height has been reached.

The wall block of this invention may be of any size and shape. For most end consumer purposes, a preferred wall block is about 3 inches high and 12 inches wide at its front face, and 10 inches deep along its bottom member. For civil engineering purposes, the wall block can have any desired size and shape.

The wall block may be formed of any suitable material. Desirable materials are polymers that may be structural foam molded, such as medium grade polypropylene. Such materials may be reinforced in a conventional way, i.e., by the addition of filler materials such as fiberglass of the like. By the use of structural foam molding techniques, the blocks are inexpensive to manufacture, lightweight, yet durable and strong and can have any angular orientation. Being formed substantially entirely of plastic the blocks are not subject to environmental deterioration, have excellent dielectric characteristics and can be provided with most any color or combination of colors.

The preferred block-forming material is a structural foam, that is, an injection molded engineering plastic either preblended with a chemical blowing agent which, when heated, releases inert gas that disperses through the polymer melt, or into which an inert gas is introduced. When the gas/resin mixture is shot under pressure into the mold cavity, the gas expands within the plasticized material as it fills the mold, producing an internal cellular structure as well as a tough external skin at the mold face. Structural foams are well known and commercially available, for example, from General Electric as foamable grades of their LEXAN polycarbonate resins, NORYL thermoplastic resin and VALOX thermoplastic polyester resin. Further details of these resins and the structural foam process are found in *The Handbook of Engineering Structural Foam* published by General Electric, the subject matter of which is incorporated herein in its entirety by reference. Alternative block-forming materials, foamed or otherwise, can be substituted for the structural foam, but it has been found that the structural foam provides a rigid frame capable of withstanding environmental and other external forces normally encountered in use.

The block, in one embodiment, is desirably of a size and weight that it may be easily lifted and placed in position by a consumer since such blocks are primarily intended for use in erecting a retaining wall of limited height, for example, up to about five feet for landscaping purposes. The color of the wall block can be varied according to consumer preference.

In addition, according to a modified embodiment of the present invention, the front of the wall block may be provided by a separate facing element secured in any conventional manner, such as by tabs on the back of a facing member snapped into openings or recesses on the front member of a wall block.

The front face of the wall blocks themselves or of the separate facing members, can have any aesthetic or functional design consistent with architectural or other requirements. They can be planar, convex or concave; they may be smooth or rough. Thus, the front face of the retaining wall made from such blocks may have a variety of different appearances and/or colors to satisfy a consumer's preference.

The above and other objects of the invention, as well as many of the attendant advantages thereof, will become more readily apparent when reference is made to the following detailed description, taken in conjunction with the accompanying drawings.

DETAILED DESCRIPTION OF THE PREFERRED EMBODIMENT

Figure 1:
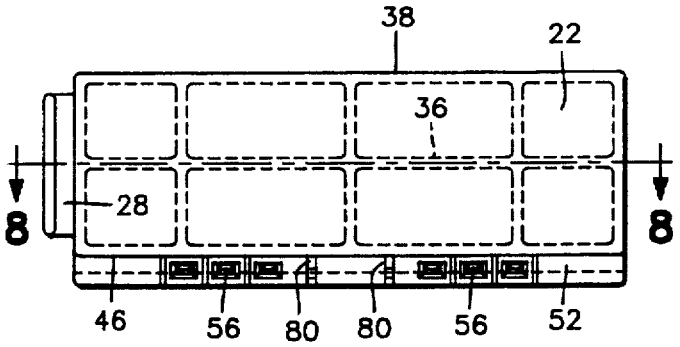
FIG. 1 is a front elevational view of a preferred form of a plastic wall block according to the instant inventive concepts with dotted lines illustrative of surfaces concealed from view.

In describing a preferred embodiment of the invention as illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose. Likewise, while preferred dimensions are set forth to describe the best mode currently known for the plastic wall block system of this invention, these dimensions are illustrative and not limiting on the instant inventive concepts.

For example, end consumer wall blocks are shown and described. It is envisioned as being within the inventive concepts of the present invention to enlarge the scale of the depicted wall block for use in civil engineering structures.

Figure 2:
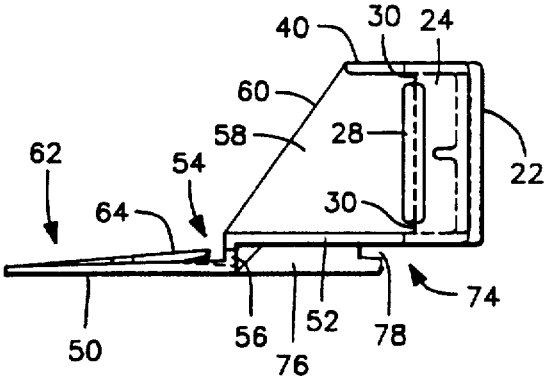
FIG. 2 is a left side elevational view of the wall block of FIG. 1.
Figure 3:
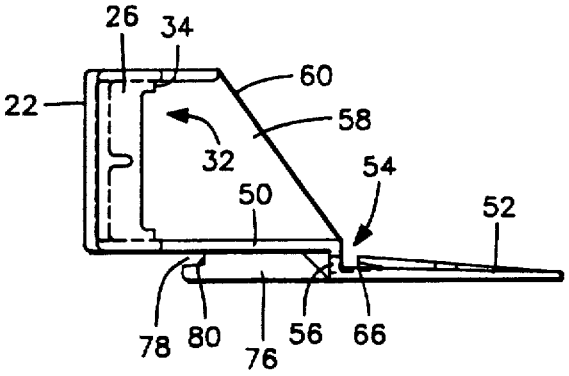
FIG. 3 is a right side elevational view thereof.
Figure 4:
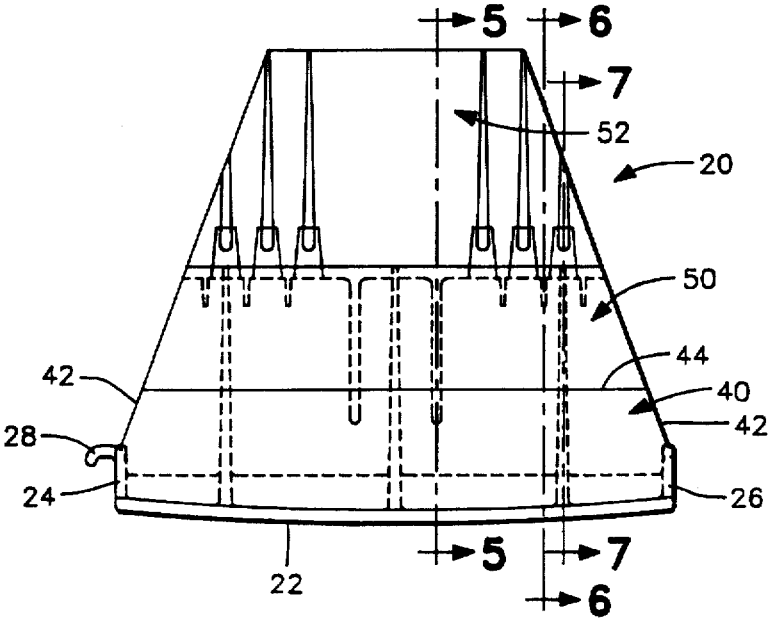
FIG. 4 is a top plan view of the wall block of FIG. 1.
Figure 5:
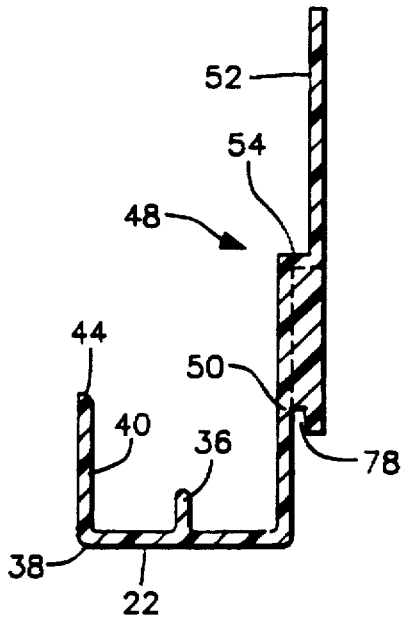
FIG. 5 is a sectional view taken along line 5—5 of FIG. 4.
Figure 6:
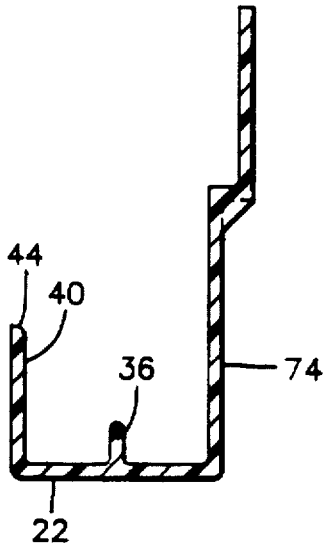
FIG. 6 is a sectional view taken along line 6—6 of FIG. 4.
Figure 7:
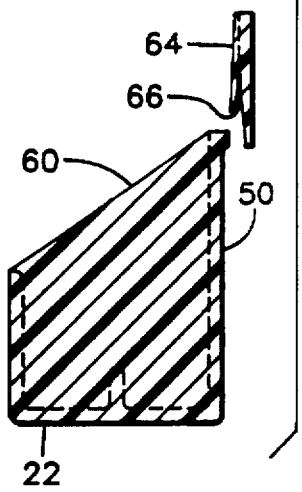
FIG. 7 is a sectional view taken along line 7—7 of FIG. 4.
Figure 8:
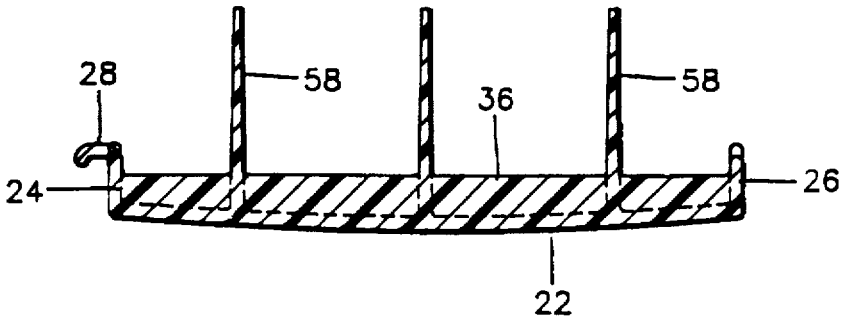
FIG. 8 is a sectional view taken along line 8—8 of FIG. 1.
Figure 10:
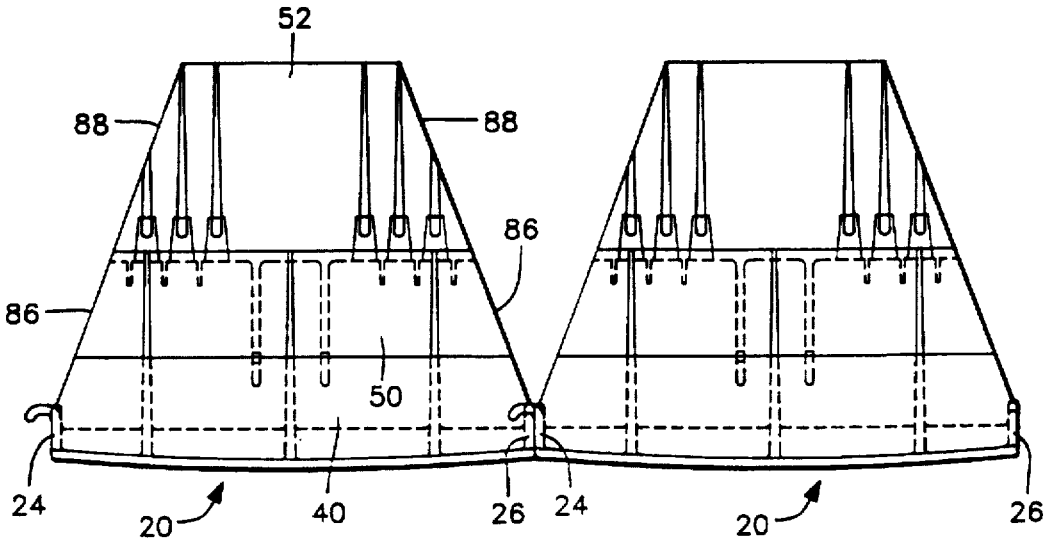
FIG. 10 is a top plan view illustrating the lateral connection of adjacent wall blocks in a single course of a straight retaining wall.

With reference now to the drawings in general, and FIGS. 1 through 8 in particular, a preferred embodiment of a plastic wall block is schematically shown at 20 as comprising a front member 22 having rearwardly extending projections or sidewalls 24, 26. Projection 24 includes a curved lip 28 for engaging with portions of projection 26 of an adjacent block 20 as is shown in FIG. 10 to form a horizontal course of blocks. As seen in FIGS. 2 and 3, the curved lip 28 is spaced between portions 30 of sidewall 24. Similarly, a portion 32 of sidewall 26 may be recessed between sidewall portions 34 to receive the curved lip 28 of an adjacent wall block.

Extending between and joined to sidewalls 24 and 26, a horizontally extending rib 36 may be formed on the rear of the front member 22 for reinforcing the same, if desired.

Extending generally horizontally and rearwardly from an upper edge 38 of the front member 22 is an upper or top member 40. As seen, the top member 40 extends along sidewalls 24 and 26 and then tapers inwardly and rearwardly along side edge surfaces 42 to a terminal or rear edge 44.

A bottom member 48 extends generally horizontally and rearwardly from the lowermost edge 46 of front member 22. Bottom member 48 includes a forwardmost or front section 50 and a vertically offset, parallel, rear section 52, interconnected by a vertically extending bridge section 54.

Extending between and perpendicular to the front, top and bottom members 22, 40 and 48 a plurality of strengthening ribs 58 may be provided. The ribs 58 taper down from the rearmost edge 44 of top member 40 to the rearmost edge of front section 50 of the bottom member 48 along angled edges 60.

Bridge section 52 includes a plurality of rectangular cut-outs or tapered openings 56 which facilitate structural foam molding of a plurality of grid-connecting fingers on upper surface 62 of the rear section 50. Fingers 64 project forwardly at a preferred inclination of about 4° to guide a transverse bar or strand of a length of grid-like sheet of reinforcing material into tapered recesses 66 formed between the fingers and the upper surface of the bottom member 48.

Figure 11:
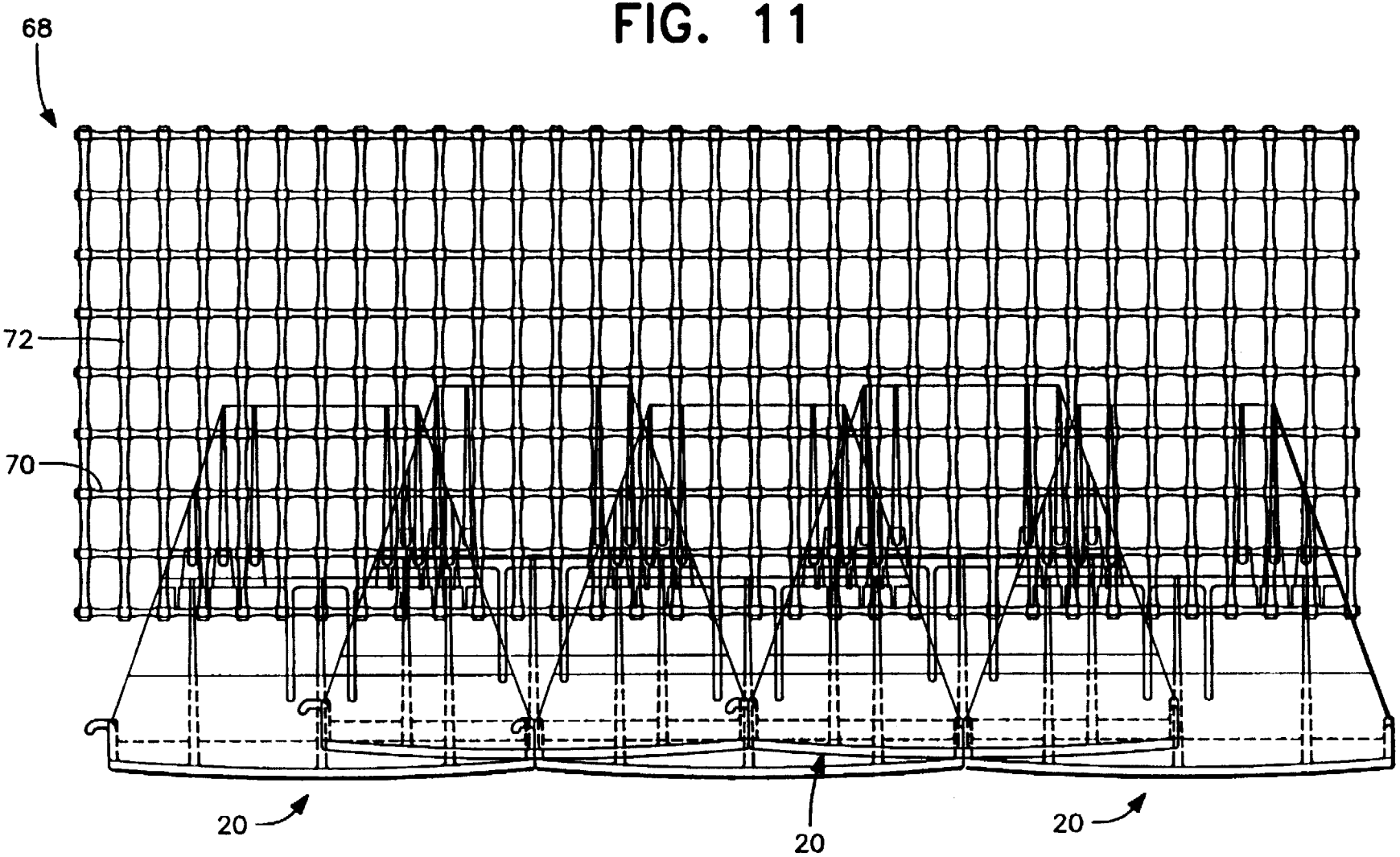
FIG. 11 is a top plan view illustrating the manner in which a plurality of wall blocks in such a retaining wall are stacked in laterally staggered courses with a grid-like sheet of reinforcing material secured to selected wall blocks.

A uniaxially stretched geogrid as shown in FIG. 11 (or other apertured sheet-like grid-like sheet of material reinforcing means) 68, is placed on a course of blocks 20. With a uniaxially stretched geogrid, a bar 70 thereof is captured by the decreasing height of the recesses 66 as the geogrid 68 is drawn in a direction away from the blocks 20. With a biaxially stretched geogrid or other grid-like material (not shown), a transverse strand or the like would be similarly captured by the recesses 66 as the sheet material is tensioned.

The grid-like sheet of material section 68 illustrated in the drawings is representative of an extended length of grid-like sheet of material which is to be secured to a plastic wall block 20 and typically measures four feet wide in the direction of the transverse bars 70, and anywhere from four to twenty-five feet or more in length in the direction of the longitudinal axis of the strands 72.

It is possible at reduced heights, for example, below six feet in height, to eliminate the need for the use of a reinforcing grid-like sheet of material. The fill material may be sufficient to hold a plurality of courses of wall blocks in place, provided, of course, there is limited seismic activity.

Returning to FIGS. 2–7, a lower surface 74 of front section 52 of bottom member 48 includes a plurality of downwardly projecting hooks 76. Hooks 76 preferably define a tapered recess 78 of about 5° with the bottom surface 74 of the front section 52 of the bottom member 48. In the preferred embodiment, there is a hook 76 positioned on either side of the longitudinal center line of each block 20.

Figure 9:
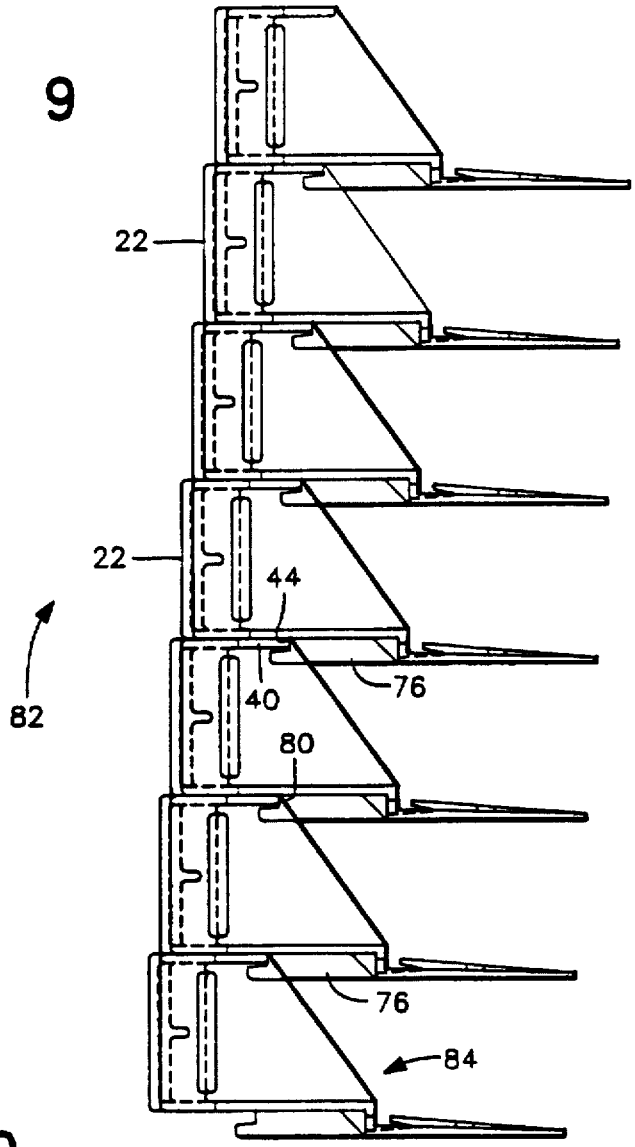
FIG. 9 is a side view illustrating the manner in which a plurality of a blocks according to this invention are stacked to rearwardly offset the front face of a resultant retaining wall.

As shown in FIG. 9, in erecting a retaining wall, since the course are laterally staggered, the hooks 76 projecting from the bottom member 48 of each block 20 engage with the top members 40 of a pair of laterally juxtaposed lower blocks. The rear edges 44 of the top member 40 of the lower blocks are engaged by the inner surface 80 of the recess 78 of the superimposed block to position the front faces of superimposed blocks relative to each other.

In the preferred embodiment shown, the distance from the front face 22 to the inner surface 80 of the recess 78 is less than the distance from the front face 22 to the rear edge 44 of the top member 40. Accordingly, when a plurality of blocks 20 are vertically stacked as in FIG. 9, the front faces are rearwardly offset with respect to each other. This provides improved structural integrity and an aesthically pleasing retaining wall appearance.

In constructing a retaining wall 82, such as shown in FIG. 9, using the plastic wall block system of the instant invention, a first course 84 of plastic wall blocks 20 is positioned with the blocks side-by-side, depending upon the amount of curvature, if any, of the wall. As shown in FIG. 10, the blocks 20 may be aligned horizontally in a straight line.

Figure 12:
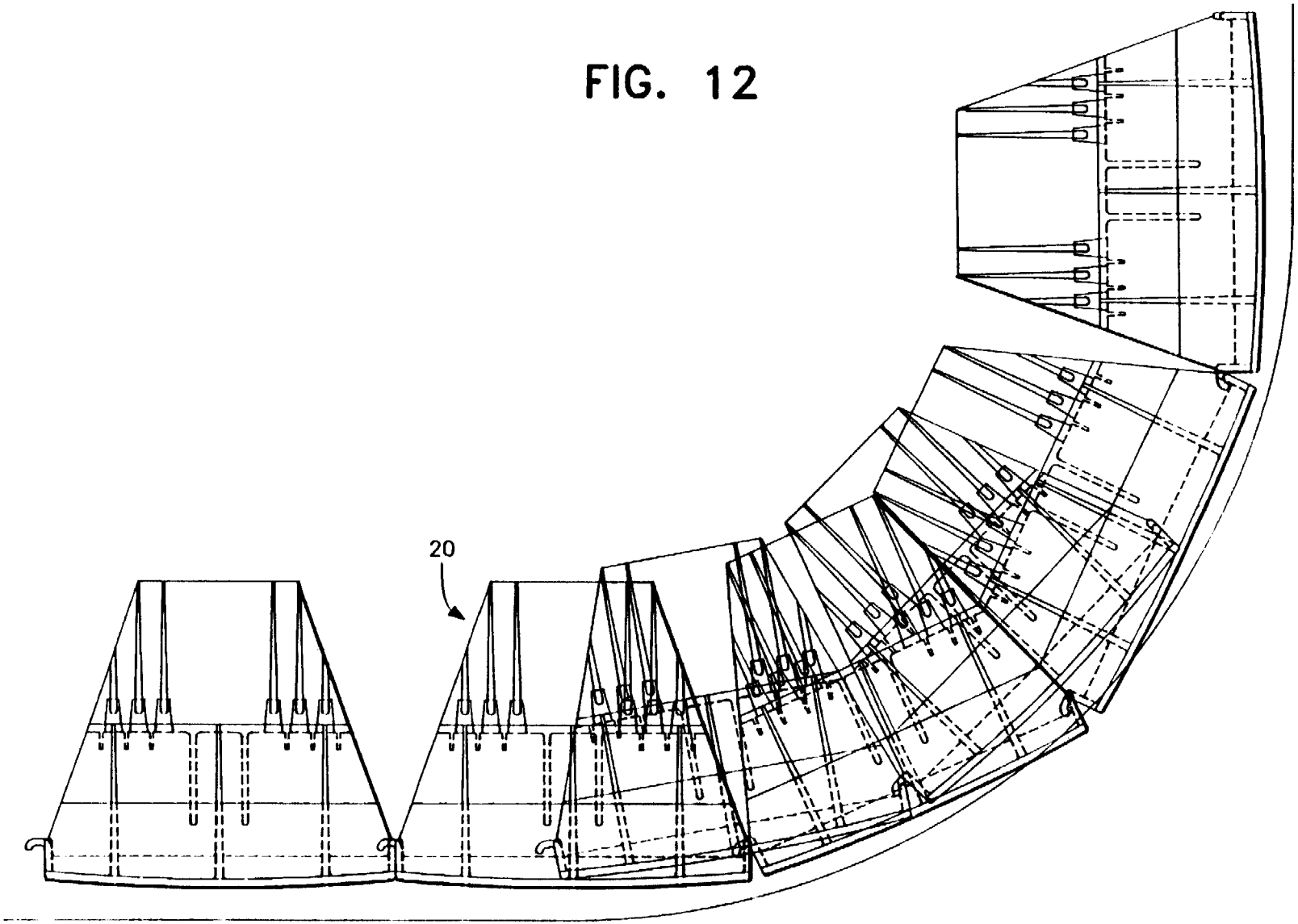
FIG. 12 is a top plan view illustrating the manner in which a plurality of wall blocks are stacked in laterally staggered courses to define an outwardly curved retaining wall according to this invention.

Alternatively, the interengagement of adjacent blocks through the use of an arcuate or curved lip 20 along with the converging side edges of the top and bottom members 40, 48 enables the wall blocks to be used in the formation of a curved retaining wall as seen in FIG. 12. As a curved course is formed, the recesses 78 of the fingers 76, may not completely engage the top member 40 of the next lower course of blocks 20. To accommodate such a situation, the length of hooks 76 can be increased so that there is some engagement of the rear edge 44 of top member 40 within the recess 78.

The area behind the front members 22 of the blocks 20 is progressively backfilled with soil or other aggregate as the courses are laid to secure the extended lengths of grid-like sheet of material sections 68 within the fill material. The grid-like sheets of material 68 function to reinforce the fill and thereby create a contiguous mass in a well known manner.

With respect to FIGS. 13–18, an alternate embodiment of the wall block of the present invention is shown generally at 100. Like parts, with reference to the embodiments shown in FIGS. 1–12, are indicated by the same reference numeral used with a prime designation. The modified wall block 100 is designed to receive a separate front facing member 102.

Recessed rearwardly from the location where the front facing member 102 will be secured is a vertically extending wall 104 having a forwardly extending support rib 106. In the wall 104, two vertically extending openings 108 are located on opposed lateral edges and two horizontally extending openings 110 are located across the top edge.

Openings 108 and 110 are adapted to cooperate with projections 128 spaced inwardly from the side edge 126 of facing member 102. The projections 128 extend rearwardly from the facing member 102 and terminate in hooked ends 130 for passage through openings 108 for holding the sides of the facing member 102 in position.

Figure 13:
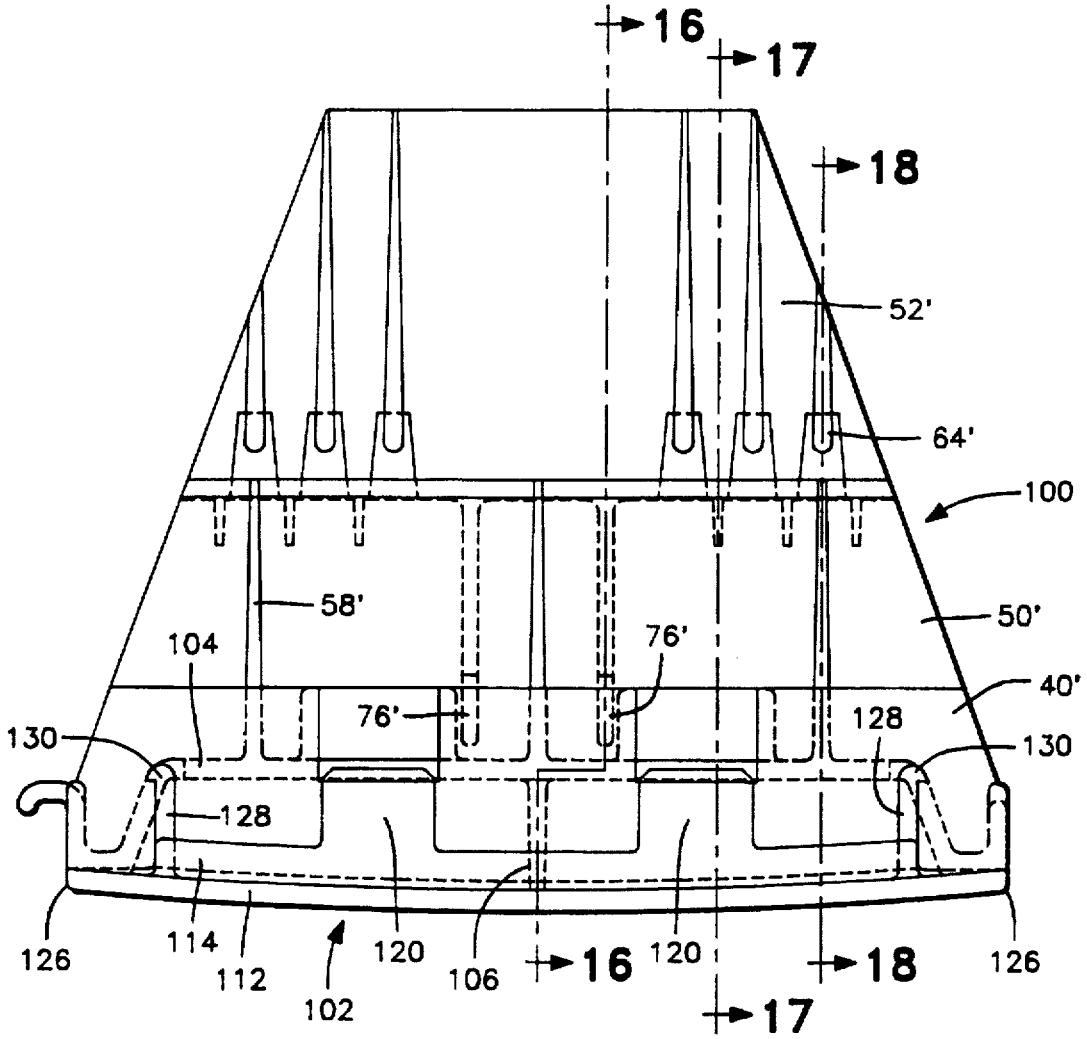
FIG. 13 is a plan view of an alternate embodiment of a plastic wall block according to the instant invention concepts incorporating a separate facing member, with dotted lines illustrative of surfaces concealed from view.
Figure 14:
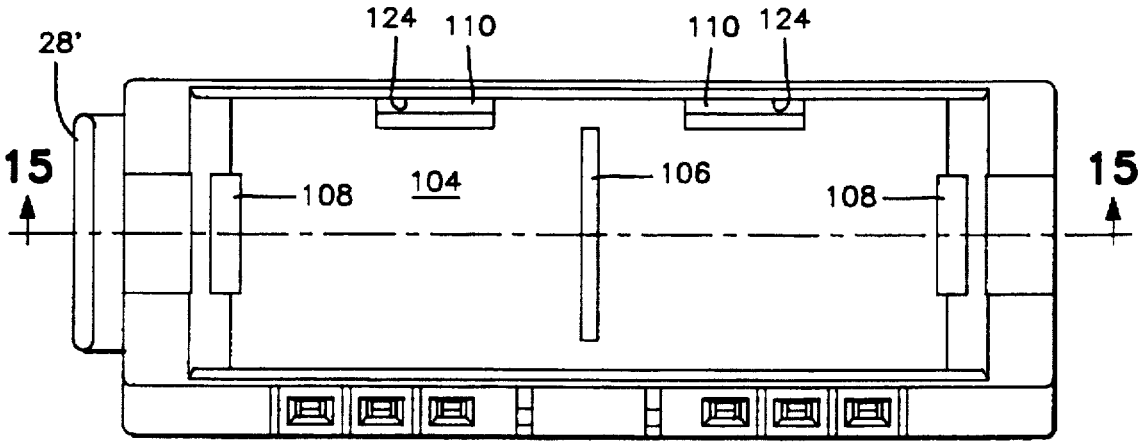
FIG. 14 is a front view of the plastic wall block of FIG. 13 with the facing member removed.
Figure 15:
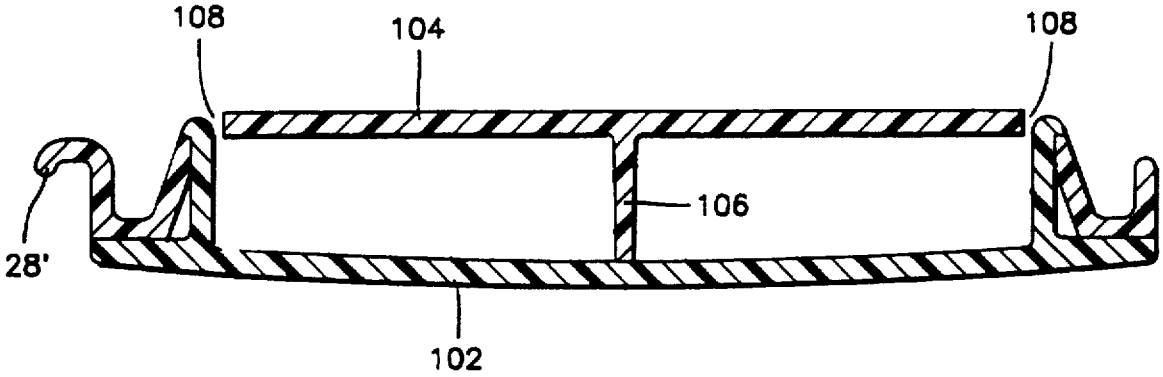
FIG. 15 is an enlarged partial sectional view taken along lines 15—15 of FIG. 14, with a facing member secured to the wall block.

The facing member 102 also includes rearwardly extending elements 114 and 118 spaced from the edges 112 and 116, respectively as seen in FIGS. 13 and 15. The projection 114 engages below the top member 40' and the projection 118 engages above the bottom member 48' as seen particularly in FIG. 16.

Figure 16:
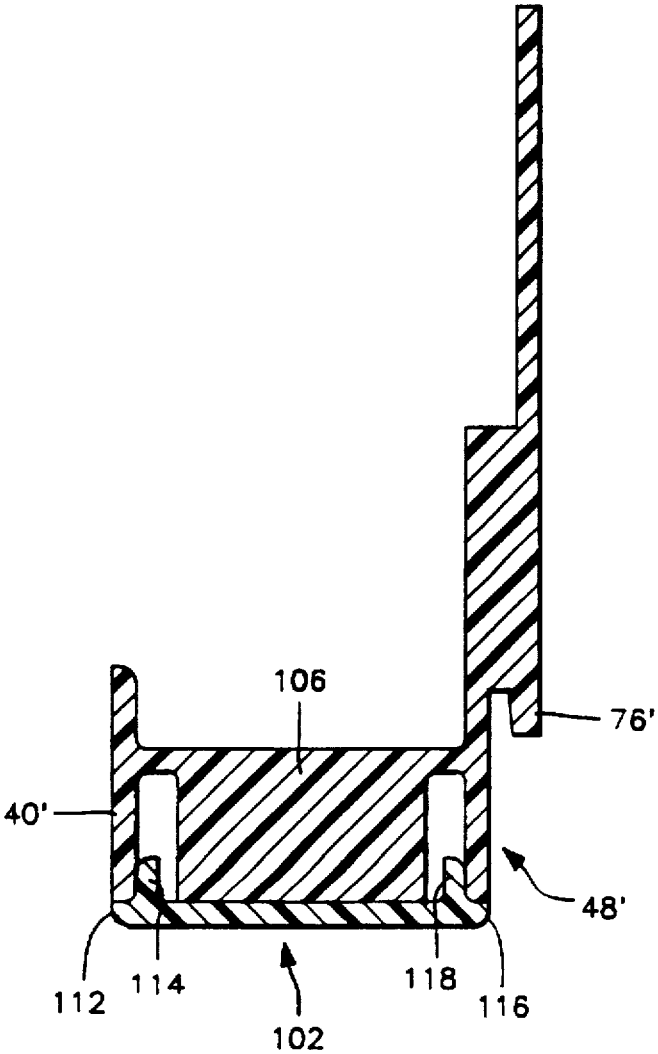
FIG. 16 is a sectional view taken along line 16—16 of FIG. 13.
Figure 17:
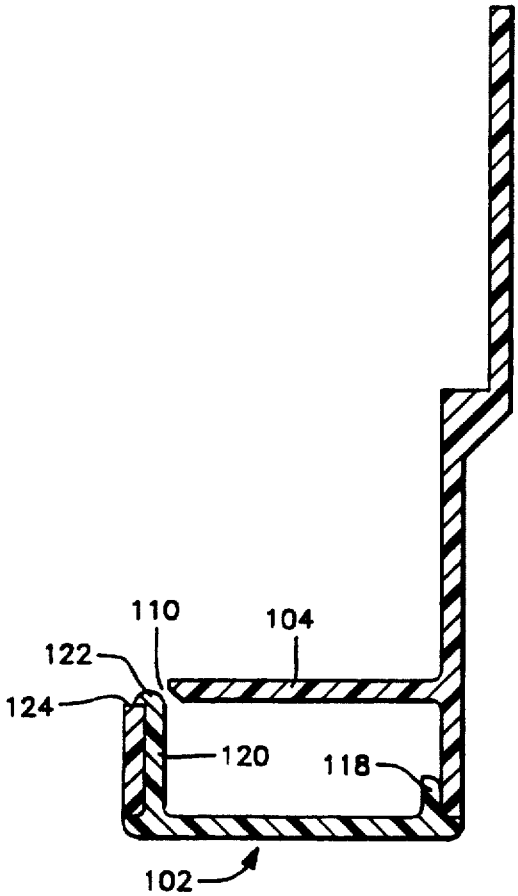
FIG. 17 is a sectional view taken along line 17—17 of FIG. 13.
Figure 18:
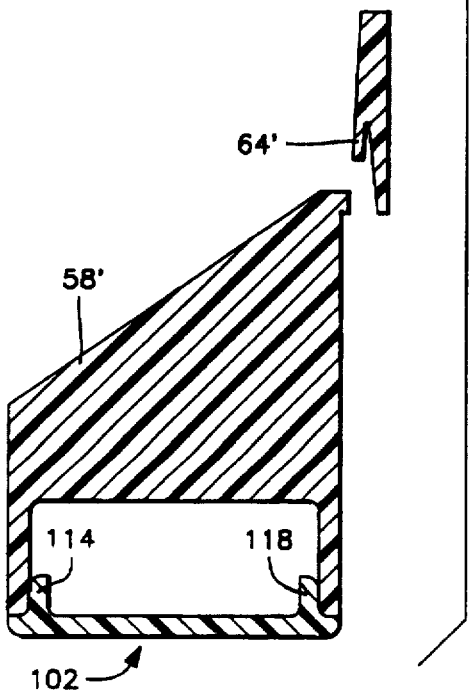
FIG. 18 is a sectional view taken along lines 18—18 of FIG. 13.

At two places along the surface 114, are, as shown in FIGS. 13 and 16, projections 120 terminating in hooked ends 122. The projections 120 extend until the hooked end 122 pass through the opening 110 in the wall 104 so that the hooked ends snap behind edge 124 of the openings 110.

By the four snap connections of the hooked ends 122, 130 within openings 108, 110 in the wall 104, the front facing member is securely mounted on the wall block 100. With this embodiment, it is not intended that, once the front facing member 102 is secured to the wall block 100, it be removed. However, it is within the scope of the present invention that the front facing members may be removably secured to the wall block in any conventional manner (not shown) so that, if it is desired to change the color and/or appearance of a front face on a wall block 100, the front facing member may be removed and replaced by another element.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A wall block to be used for forming a retaining wall including a plurality of superimposed courses each comprising a plurality of laterally juxtaposed wall blocks and grid-like sheets of materials attached to selected wall blocks for reinforcing fill material behind the retaining wall, said wall block comprising:

a front member, a top member, a bottom member, and opposed sidewalls extending between said top and bottom members and said front member, a plurality of finger members extending from said bottom member, said finger members being laterally spaced apart by a distance corresponding to a spacing between selected openings in end portions of the grid-like sheets of material for securing the grid-like sheets of material to selected wall blocks, one of said sidewalls defining first sidewall engaging portions and the other of said side walls defining second sidewall engaging portions, said first sidewall engaging portions of one wall block being engageable with said second sidewall engaging portions of an adjacent wall block in a course of wall blocks to laterally position the wall blocks in each course relative to each other, and said bottom member defining bottom engaging portions, said top member defining top engaging portions, said bottom engaging portions of one wall block being engageable with said top engaging portions of at least one wall block in a course below to vertically position superimposed wall blocks relative to each other.

2. A wall block as claimed in claim 1, wherein said wall block is made of plastic.

3. A wall block as claimed in claim 1, wherein said first sidewall engaging portions comprise a vertically extending, outwardly projecting lip having a top edge and a bottom edge and defining a forwardly facing arcuate surface therebetween, and said second sidewall engaging portions comprise a recess having a top edge and a bottom edge connected by a vertically extending edge, said bottom edge of said lip resting on said bottom edge of said recess and said arcuate surface of said first sidewall engaging portions receiving said vertical edge of said recess when adjacent wall blocks in a course of wall blocks are interengaged.

4. A wall block as claimed in claim 1, wherein said bottom engaging portions comprise hook members extending downwardly from said bottom member and said top engaging portions comprise rear edge portions of said top wall received in said hook members when superimposed wall blocks are interengaged.

5. A wall block as claimed in claim 4, wherein said front member includes a front face forming part of the exterior surface of a retaining wall formed from a plurality of said wall blocks, the distance between the front face of said front member and said hook members being less than the distance between the front face of said front member and said rear edge portions of said top member engaged by said hook members to offset the front faces of superimposed courses of wall blocks in a retaining wall formed from a plurality of said wall blocks.

6. A wall block as claimed in claim 4, wherein each wall block includes at least one hook member spaced on each side of a centerline of said wall block to engage said rear edge portions of top members of a pair of adjacent wall blocks in a lower course when the wall blocks in superimposed courses are laterally staggered.

7. A wall block as claimed in claim 1, wherein said finger members define tapered recesses to frictionally engage portions of the grid-like sheet of material.

8. A wall block as claimed in claim 1, further including a separate facing member securable to said front member of each of said wall blocks to permit the front face of the retaining wall to be aesthetically altered.

9. A wall block to be used for forming a retaining wall including a plurality of superimposed courses each comprising a plurality of laterally juxtaposed wall blocks and grid-like sheets of materials attached to selected wall blocks for reinforcing fill material behind the retaining wall, said wall block comprising:

a front member, a top member, a bottom member, and opposed sidewalls extending between said top and bottom members and said front member, and a plurality of finger members extending from said bottom member, said finger members being laterally spaced apart by a distance corresponding to a spacing between selected openings in end portions of the grid-like sheets of material for securing the grid-like sheets of material to selected wall blocks.

10. A wall block as claimed in claim 9, wherein said wall block is made of plastic.

11. A wall block as claimed in claim 9, wherein one of said sidewalls defines first sidewall engaging portions and the other of said side walls defines second sidewall engaging portions, said first sidewall engaging portions of one wall block being engageable with said second sidewall engaging portions of an adjacent wall block in a course of wall blocks to laterally position the wall blocks in each course relative to each other.

12. A wall block as claimed in claim 11, wherein said first sidewall engaging portions comprise a vertically extending, outwardly projecting lip having a top edge and a bottom edge and defining a forwardly facing arcuate surface therebetween, and said second sidewall engaging portions comprise a recess having a top edge and a bottom edge connected by a vertically extending edge, said bottom edge of said lip resting on said bottom edge of said recess and said arcuate surface of said first sidewall engaging portions receiving said vertical edge of said recess when adjacent wall blocks in a course of wall blocks are interengaged.

13. A wall block as claimed in claim 9, wherein said bottom member defines bottom engaging portions, said top member defines top engaging portions, said bottom engaging portions of one wall block being engageable with said top engaging portions of at least one wall block in a course below to vertically position superimposed wall blocks relative to each other.

14. A wall block as claimed in claim 13, wherein said bottom engaging portions comprise hook members extending downwardly from said bottom member and said top engaging portions comprise rear edge portions of said top wall received in said hook members when superimposed wall blocks are interengaged.

15. A wall block as claimed in claim 14, wherein said front member includes a front face forming part of the exterior surface of a retaining wall formed from a plurality of said wall blocks, the distance between the front face of said front member and said hook members being less than the distance between the front face of said front member and said rear edge portions of said top member engaged by said hook members to offset the front faces of superimposed courses of wall blocks in a retaining wall formed from a plurality of said wall blocks.

16. A wall block as claimed in claim 14, wherein each wall block includes at least one hook member spaced on each side of a centerline of said wall block to engage said rear edge portions of top members of a pair of adjacent wall blocks in a lower course when the wall blocks in superimposed courses are laterally staggered.

17. A wall block as claimed in claim 9, wherein said finger members define tapered recesses to frictionally engage portions of the grid-like sheet of material.

18. A wall block as claimed in claim 9, further including a separate facing member securable to said front member of each of said wall blocks to permit the front face of the retaining wall to be aesthetically altered.

19. A wall block to be used for forming a retaining wall including a plurality of superimposed courses each comprising a plurality of laterally juxtaposed wall blocks, said wall block comprising:

a front member, a top member, a bottom member, and opposed sidewalls extending between said top and bottom members and said front member, and one of said sidewalls defining first sidewall engaging portions and the other of said side walls defining second sidewall engaging portions, said first sidewall engaging portions of one wall block being engageable with said second sidewall engaging portions of an adjacent wall block in a course of wall blocks to laterally position the wall blocks in each course relative to each other, said first sidewall engaging portions including a vertically extending, outwardly projecting lip having a top edge and a bottom edge and defining a forwardly facing arcuate surface therebetween, and said second sidewall engaging portions including a recess having a top edge and a bottom edge connected by a vertically extending edge, said bottom edge of said lip resting on said bottom edge of said recess and said arcuate surface of said first sidewall engaging portions receiving said vertical edge of said recess when adjacent wall blocks in a course of wall blocks are interengaged.

20. A wall block as claimed in claim 19, wherein said wall block is made of plastic.

21. A wall block as claimed in claim 19, wherein s aid bottom member defines bottom engaging portions, said top member defines top engaging portions, said bottom engaging portions of one wall block being engageable with said top engaging portions of at least one wall block in a course below to vertically position superimposed wall blocks relative to each other.

22. A wall block as claimed in claim 19, further including a separate facing member securable to said front member of each of said wall blocks to permit the front face of the retaining wall to be aesthetically altered.

23. A wall block to be used for forming a retaining wall including a plurality of superimposed courses each comprising a plurality of laterally juxtaposed wall blocks, said wall block comprising:

a front member, a top member, a bottom member, and opposed sidewalls extending between said top and bottom members and said front member, and one of said sidewalls defining first sidewall engaging portions and the other of said side walls defining second sidewall engaging portions, said first sidewall engaging portions of one wall block being engageable with said second sidewall engaging portions of an adjacent wall block in a course of wall blocks to laterally position the wall blocks in each course relative to each other, said first sidewall engaging portions including a vertically extending, outwardly projecting lip having a top edge and a bottom edge and defining a forwardly facing arcuate surface therebetween, and said second sidewall engaging portions including a recess having a top edge and a bottom edge connected by a vertically extending edge, said bottom edge of said lip resting on said bottom edge of said recess and said arcuate surface of said first sidewall engaging portions receiving said vertical edge of said recess when adjacent wall blocks in a course of wall blocks are interengaged, wherein said wall block further includes a plurality of finger members extending from said bottom member, said finger members being laterally spaced apart by a distance corresponding to a spacing between selected openings in end portions of grid-like sheets of material for securing the grid-like sheets of material to selected wall blocks.

24. A wall block as claimed in claim 23, wherein said finger members define tapered recesses to frictionally engage portions of the grid-like sheet of material.

25. A wall block to be used for forming a retaining wall including a plurality of superimposed courses each comprising a plurality of laterally juxtaposed wall blocks, said wall block comprising:

a front member, a top member, a bottom member, and opposed sidewalls extending between said top and bottom members and said front member, and one of said sidewalls defining first sidewall engaging portions and the other of said side walls defining second sidewall engaging portions, said first sidewall engaging portions of one wall block being engageable with said second sidewall engaging portions of an adjacent wall block in a course of wall blocks to laterally position the wall blocks in each course relative to each other, said first sidewall engaging portions including a vertically extending, outwardly projecting lip having a top edge and a bottom edge and defining a forwardly facing arcuate surface therebetween, and said second sidewall engaging portions including a recess having a top edge and a bottom edge connected by a vertically extending edge, said bottom edge of said lip resting on said bottom edge of said recess and said arcuate surface of said first sidewall engaging portions receiving said vertical edge of said recess when adjacent wall blocks in a course of wall blocks are interengaged, wherein said bottom member defines bottom engaging portions, said top member defines top engaging portions, said bottom engaging portions of one wall block being engageable with said top engaging portions of at least one wall block in a course below to vertically position superimposed wall blocks relative to each other, and wherein said bottom engaging portions comprise hook members extending downwardly from said bottom member and said top engaging portions comprise rear edge portions of said top wall received in said hook members when superimposed wall blocks are interengaged.

26. A wall block as claimed in claim 25, wherein said front member includes a front face forming part of the exterior surface of a retaining wall formed from a plurality of said wall blocks, the distance between the front face of said front member and said hook members being less than the distance between the front face of said front member and said rear edge portions of said top member engaged by said hook members to offset the front faces of superimposed courses of wall blocks in a retaining wall formed from a plurality of said wall blocks.

27. A wall block as claimed in claim 25, wherein each wall block includes at least one hook member spaced on each side of a centerline of said wall block to engage said rear edge portions of top members of a pair of adjacent wall blocks in a lower course when the wall blocks in superimposed courses are laterally staggered.

28. A wall block to be used for forming a retaining wall including a plurality of superimposed courses each comprising a plurality of laterally juxtaposed wall blocks, said wall block comprising:

a front member, a top member, a bottom member, and opposed sidewalls extending between said top and bottom members and said front member, and said bottom member defining bottom engaging portions, said top member defining top engaging portions, said bottom engaging portions of one wall block being engageable with said top engaging portions of at least one wall block in a course below to vertically position superimposed wall blocks relative to each other, said bottom engaging portions including hook members extending downwardly from said bottom member and said top engaging portions including rear edge portions of said top wall received in said hook members when superimposed wall blocks are interengaged.

29. A wall block as claimed in claim 28, wherein said wall block is made of plastic.

30. A wall block as claimed in claim 28, wherein one of said sidewalls defines first sidewall engaging portions and the other of said side walls defines second sidewall engaging portions, said first sidewall engaging portions of one wall block being engageable with said second sidewall engaging portions of an adjacent wall block in a course of wall blocks to laterally position the wall blocks in each course relative to each other.

31. A wall block as claimed in claim 28, wherein said front member includes a front face forming part of the exterior surface of a retaining wall formed from a plurality of said wall blocks, the distance between the front face of said front member and said hook members being less than the distance between the front face of said front member and said rear edge portions of said top member engaged by said hook members to offset the front faces of superimposed courses of wall blocks in a retaining wall formed from a plurality of said wall blocks.

32. A wall block as claimed in claim 28, further including a separate facing member securable to said front member of each of said wall blocks to permit the front face of the retaining wall to be aesthetically altered.

33. A wall block to be used for forming a retaining wall including a plurality of superimposed courses each comprising a plurality of laterally juxtaposed wall blocks, said wall block comprising:

a front member, a top member, a bottom member, and superimposed sidewalls extending between said top and bottom members and said front member, and said bottom member defining bottom engaging portions, said top member defining top engaging portions, said bottom engaging portions of one wall block being engageable with said top engaging portions of at least one wall block in a course below to vertically position superimposed wall blocks relative to each other, said bottom engaging portions including hook members extending downwardly from said bottom member and said top engaging portions including rear edge portions of said top wall received in said hook members when superimposed wall blocks are interengaged, wherein said wall block further includes a plurality of finger members extending from said bottom member, said finger members being laterally spaced apart by a distance corresponding to a spacing between selected openings in end portions of grid-like sheets of material for securing the grid-like sheets of material to selected wall blocks.

34. A wall block to be used for forming a retaining wall including a plurality of superimposed courses each comprising a plurality of laterally juxtaposed wall blocks, said wall block comprising:

a front member, a top member, a bottom member, and opposed sidewalls extending between said top and bottom members and said front member, and said bottom member defining bottom engaging portions, said top member defining top engaging portions, said bottom engaging portions of one wall block being engageable with said top engaging portions of at least one wall block in a course below to vertically position superimposed wall blocks relative to each other, said bottom engaging portions including hook members extending downwardly from said bottom member and said top engaging portions including rear edge portions of said top wall received in said hook members when superimposed wall blocks are interengaged, wherein one of said sidewalls defines first sidewall engaging portions and the other of said side walls defines second sidewall engaging portions, said first sidewall engaging portions of one wall block being engageable with said second sidewall engaging portions of an adjacent wall block in a course of wall blocks to laterally position the wall blocks in each course relative to each other, and wherein said first sidewall engaging portions comprise a vertically extending, outwardly projecting lip having a top edge and a bottom edge and defining a forwardly facing arcuate surface therebetween, and said second sidewall engaging portions comprise a recess having a top edge and a bottom edge connected by a vertically extending edge, said bottom edge of said lip resting on said bottom edge of said recess and said arcuate surface of said first sidewall engaging portions receiving said vertical edge of said recess when adjacent wall blocks in a course of wall blocks are interengaged.

35. A wall block to be used for forming a retaining wall including a plurality of superimposed courses each comprising a plurality of laterally juxtaposed wall-blocks, said wall block comprising:

a front member, a top member, a bottom member, and opposed sidewalls extending between said top and bottom members and said front member, and said bottom member defining bottom engaging portions, said top member defining top engaging portions, said bottom engaging portions of one wall block being engageable with said top engaging portions of at least one wall block in a course below to vertically position superimposed wall blocks relative to each other, said bottom engaging portions including hook members extending downwardly from said bottom member and said top engaging portions including rear edge portions of said top wall received in said hook members when superimposed wall blocks are interengaged, wherein each wall block includes at least one hook member spaced on each side of a centerline of said wall block to engage said rear edge portions of top members of a pair of adjacent wall blocks in a lower course when the wall blocks in superimposed courses are laterally staggered.

36. A wall block as claimed in claim 35, wherein said finger members define tapered recesses to frictionally engage portions of the grid-like sheet of material.

37. A wall block system to be used for forming a retaining Wall including a plurality of superimposed courses each comprising a plurality of laterally juxtaposed wall blocks, said wall block comprising:

a plurality of wall blocks each having a front member, a top member, a bottom member, and opposed sidewalls extending between said top and bottom members and said front member, a grid-like sheet of material including end portions to be secured to selected wall blocks with the remainder of the grid-like sheet of material extending rearwardly therefrom into fill material behind the retaining wall to reinforce the retaining wall, said end portions of said grid-like sheet of material defining a plurality of laterally spaced openings, a plurality of finger members extending from said bottom member, said finger members being laterally spaced apart by a distance corresponding to a spacing between selected openings in said end portions of said grid-like sheet of material for securing said grid-like sheet of material to selected wall blocks, one of said sidewalls defining first sidewall engaging portions and the other of said side walls defining second sidewall engaging portions, said first sidewall engaging portions of one wall block being engageable with said second sidewall engaging portions of an adjacent wall block in a course of wall blocks to laterally position the wall blocks in each course relative to each other, and said bottom member defining bottom engaging portions, said top member defining top engaging portions, said bottom engaging portions of one wall block being engageable with said top engaging portions of at least one wall block in a course below to vertically position superimposed wall blocks relative to each other.

38. A wall block system as claimed in claim 37, wherein said wall blocks are made of plastic.

39. A wall block system as claimed in claim 37, wherein said first sidewall engaging portions comprise a vertically extending, outwardly projecting lip having a top edge and a bottom edge and defining a forwardly facing arcuate surface therebetween, and said second sidewall engaging portions comprise a recess having a top edge and a bottom edge connected by a vertically extending edge, said bottom edge of said lip resting on said bottom edge of said recess and said arcuate surface of said first sidewall engaging portions receiving said vertical edge of said recess when adjacent wall blocks in a course of wall blocks are interengaged.

40. A wall block system as claimed in claim 37, wherein said bottom engaging portions comprise hook members extending downwardly from said bottom member and said top engaging portions comprise rear edge portions of said top wall received in said hook members when superimposed wall blocks are interengaged.

41. A wall block system as claimed in claim 40, wherein said front member includes a front face forming part of the exterior surface of a retaining wall formed from a plurality of said wall blocks, the distance between the front face of said front member and said hook members being less than the distance between the front face of said front member and said rear edge portions of said top member engaged by said hook members to offset the front faces of superimposed courses of wall blocks in a retaining wall formed from a plurality of said wall blocks.

42. A wall block system as claimed in claim 40, wherein each wall block includes at least one hook member spaced on each side of a centerline of said wall block to engage said rear edge portions of top members of a pair of adjacent wall blocks in a lower course when the wall blocks in superimposed courses are laterally staggered.

43. A wall block system as claimed in claim 37, wherein said finger members define tapered recesses to frictionally engage portions of the grid-like sheet of material.

44. A wall block systems as claimed in claim 37, further including a separate facing member securable to said front member of each of said wall blocks to permit the front face of the retaining wall to be aesthetically altered.

45. A retaining wall comprising:

a plurality of superimposed courses each comprising a plurality of laterally juxtaposed wall blocks, each wall block having a front member, a top member, a bottom member, and opposed sidewalls extending between said top and bottom members and said front member, a grid-like sheet of material including end portions to be secured to selected wall blocks with the remainder of the grid-like sheet of material extending rearwardly therefrom, said end portions of said grid-like sheet of material defining a plurality of laterally spaced openings, a plurality of finger members extending from said bottom member, said finger members being laterally spaced apart by a distance corresponding to a spacing between selected openings in said end portions of said grid-like sheet of material, said end portions of said grid-like sheet of material being engaged over said finger members of selected wall blocks, one of said sidewalls defining first sidewall engaging portions and the other of said side walls defining second sidewall engaging portions, said first sidewall engaging portions of one wall block being engaged with said second sidewall engaging portions of an adjacent wall block in a course of wall blocks to laterally position the wall blocks in each course relative to each other, said bottom member defining bottom engaging portions, said top member defining top engaging portions, said bottom engaging portions of one wall block being engaged with said top engaging portions of at least one wall block in a course below to vertically position superimposed wall blocks relative to each other, and fill material behind said wall blocks, portions of said grid-like sheet of material being embedded in said fill material.

46. A retaining wall as claimed in claim 45, wherein said wall blocks are made of plastic.

47. A retaining wall as claimed in claim 45, wherein said first sidewall engaging portions comprise a vertically extending, outwardly projecting lip having a top edge and a bottom edge and defining a forwardly facing arcuate surface therebetween, and said second sidewall engaging portions comprise a recess having a top edge and a bottom edge connected by a vertically extending edge, said bottom edge of said lip resting on said bottom edge of said recess and said arcuate surface of said first sidewall engaging portions receiving said vertical edge of said recess when adjacent wall blocks in a course of wall blocks are interengaged.

48. A retaining wall as claimed in claim 45, wherein said bottom engaging portions comprise hook members extending downwardly from said bottom member and said top engaging portions comprise rear edge portions of said top wall received in said hook members when superimposed wall blocks are interengaged.

49. A retaining wall as claimed in claim 48, wherein said front member includes a front face forming part of the exterior surface of a retaining wall formed from a plurality of said wall blocks, the distance between the front face of said front member and said hook members being less than the distance between the front face of said front member and said rear edge portions of said top member engaged by said hook members to offset the front faces of superimposed courses of wall blocks in a retaining wall formed from a plurality of said wall blocks.

50. A retaining wall as claimed in claim 48, wherein each wall block includes at least one hook member spaced on each side of a centerline of said wall block to engage said rear edge portions of top members of a pair of adjacent wall blocks in a lower course when the wall blocks in superimposed courses are laterally staggered.

51. A retaining wall as claimed in claim 45, wherein said finger members define tapered recesses to frictionally engage portions of the grid-like sheet of material.

52. A retaining wall as claimed in claim 45, further including a separate facing member securable to said front member of each of said wall blocks to permit the front face of the retaining wall to be aesthetically altered.

53. A wall block to be used for forming a retaining wall including a plurality of superimposed courses each comprising a plurality of laterally juxtaposed wall blocks, said wall block comprising:

a front member, a top member, a bottom member, and opposed sidewalls extending between said top and bottom members and said front member, a separate facing member said front member and said facing member including interengageable portions whereby selected facing members may be secured to said front members of said wall blocks to permit a front face of the retaining wall to be aesthetically altered.

54. A wall block as claimed in claim 53, wherein said interengageable portions comprise at least one opening defined in one of said front and facing members, at least one projection defined on the other of said front and facing members, said projection being engageable in said opening to secure said front and facing members to each other.

55. A wall block as claimed in claim 54, further including portions defining a shoulder at an edge of said opening, said projection terminating in a hook engageable over said shoulder.

56. A wall block as claimed in claim 55, further including a plurality of spaced openings and shoulders, and a complementary number of projections, each of said projections terminating in a hook engageable over a respective shoulder.

57. A wall block as claimed in claim 56, wherein said openings are defined in said front face of said wall block, said facing member including a front surface defining the front face of the retaining wall and a rear surface, said projections extending from said rear surface of said facing member.

* * * * *